United States Patent [19]

Stewart

[11] Patent Number: 4,889,056

[45] Date of Patent: Dec. 26, 1989

[54] COVER AND LATCHING MECHANISM FOR RAIL CAR LOADING HATCH

[75] Inventor: Thomas Stewart, Candler, N.C.

[73] Assignee: Trinity Industries, Inc., Dallas, Tex.

[21] Appl. No.: 716,577

[22] Filed: Mar. 27, 1985

[51] Int. Cl.[4] ..... B61D 39/00

[52] U.S. Cl. ..... 105/377; 220/314; 292/256.5; 292/DIG. 49

[58] Field of Search ..... 105/377; 292/DIG. 49, 292/286.5; 220/314, 315

[56] References Cited

U.S. PATENT DOCUMENTS

| | | | |
|---|---|---|---|
| 1,260,299 | 3/1918 | Banes | 220/315 |
| 2,003,927 | 6/1935 | Ecoff | 105/377 |
| 2,745,362 | 5/1956 | Lunde | 105/377 |
| 2,901,279 | 8/1959 | MacNaught et al. | 292/256.5 |
| 3,217,661 | 11/1965 | Kemp | 105/377 |
| 3,344,947 | 10/1967 | Gallup | 220/314 |
| 3,433,357 | 3/1969 | Nolte | 292/256.5 |
| 3,848,912 | 11/1974 | Jensen et al. | 292/256.5 |
| 3,888,528 | 6/1975 | Jericijo | 292/DIG. 49 |
| 4,000,703 | 1/1977 | Halliar | 292/256.5 |
| 4,053,177 | 10/1977 | Stammreich et al. | 292/DIG. 49 |
| 4,126,094 | 11/1978 | Zimmehe et al. | 105/377 |
| 4,159,137 | 6/1979 | Richter | 292/DIG. 49 |
| 4,239,008 | 12/1980 | Conlon | 105/377 |
| 4,248,160 | 2/1981 | Carney, Jr. et al. | 105/377 |
| 4,307,670 | 12/1981 | Nadherny | 292/256.5 |
| 4,365,832 | 12/1982 | Treppler | 105/377 |
| 4,388,873 | 6/1983 | Carleton et al. | 105/377 |
| 4,441,431 | 4/1984 | Carney, Jr. et al. | 105/377 |
| 4,461,219 | 7/1984 | Bateson | 105/377 |

*Primary Examiner*—Johnny D. Cherry
*Assistant Examiner*—Gary C. Hoge
*Attorney, Agent, or Firm*—Hubbard, Thurman, Turner & Tucker

[57] ABSTRACT

A generally circular cover for closing a hatch opening in a railroad car hopper is connected to a diametral support bar for limited pivotal movement to provide uniform gasket loading between the cover member and the hatch coaming. One end of the support bar is hinged to the hopper roof and the opposite end includes a cam surface and laterally projecting retaining pins for engagement with a latch member. The latch member has a somewhat channel shaped portion pivotally connected to a link which, in turn is also pivotally secured to the hopper roof. The link includes opposed trunnion portions which are engageable with the cam surface to forciby engage the support bar to hold the hatch cover closed. The latch member includes open ended slots which are engageable with the retaining pins in such a way that the latch member will not disengage from the support bar when the latch member is swung to the release position if fluid pressure within the car hopper is sufficient to force the cover toward an open position.

10 Claims, 8 Drawing Sheets

COVER AND LATCHING MECHANISM FOR RAIL CAR LOADING HATCH

BACKGROUND OF THE INVENTION

Field of the Invention

The present invention pertains to a hatch cover and latching mechanism for locking the cover in a closed position. The hatch cover is particularly adapted for railroad hopper car hatches and the like.

Background

In the art of hatch covers for railway car loading hatches and other related applications there have been several developments directed to providing covers which have latching mechanisms to minimize the chance of the hatch cover flying open when the latching mechanism is released due to fluid pressure build-up inside the car hopper. U.S. Pat. Nos. 2,745,362 to E. O. Lunde; 4,126,094 to James R. Zimmerle et al.; 4,248,160 to John L. Carney, Jr. et al.; 4,388,873 to John V. Carlton et al.; and 4,441,431 to John L. Carney et al. are examples of hopper car hatch covers wherein a generally circular cover is disposed over a cylindrical hatch, is connected to a hinged support bar and incorporates a latching mechanism for securing the cover in a closed position. Even with the development of the hatch covers described in the aforementioned patents, there are certain desirable features in railcar hatch covers and the like which have not been provided by prior art.

One desirable feature in a railcar hatch cover is a latching mechanism which is operable to securely latch and lock the cover in a closed position and which is operable to minimize the chance of unwanted violent opening of the hatch upon release of the latch mechanism in the event of pressure buildup inside the car hopper. Still other features which have been deemed desirable to provide in railcar hatch covers include a latching mechanism which is relatively easy to engage and disengage and which includes a latch member, for example, which may easily be engaged with the hatch in the partially closed position to draw the hatch downward to compress a gasket type seal and also, with minimum effort, move the latch member into a locking position wherein a latching cam or the like securely engages a cooperating member which is supporting or connected to the hatch cover.

It has further been determined that it is desirable to provide a hatch cover with means to minimize the chance of impacting the roof of the car tank or hopper to prevent chipping the exterior finish or damaging interior linings or coatings for the hopper. Still other features which are considered desirable are the provision of a relatively low profile of the hatch cover, the cover hinge and the latch mechanism in both open and closed positions. It is to this end that the present invention has been developed in an effort to meet all of the desiderata described herein as well as other features which will be apparent to those skilled in the art.

SUMMARY OF THE INVENTION

The present invention provides an improved cover and latch mechanism for a hatch opening in a railway car hopper, tank enclosure or similar bulk material storage and transport container. In accordance with one aspect of the present invention there is provided a hatch cover and latch mechanism wherein the cover is movable between closed and partially open positions while remaining connected to the latch mechanism to minimize the chance of rapid or violent opening movement of the hatch due to a buildup of pressure within a hopper or tank on which the hatch cover is used. In accordance with another aspect of the invention, the latch mechanism is operable to automatically disengage from the hatch cover when the pressure differential subsides to a level wherein the hatch cover moves or tends to move from the partially open position back to a closed position thereby assuring the release of pressure from within the tank while minimizing the chance that the hatch cover can be opened under pressure.

In accordance with another aspect of the present invention, a hatch cover and latching mechanism is provided with an improved configuration of a latch member which is engageable with a support member connected to the hatch cover to move the hatch cover toward the closed position to compress a resilient seal member and simultaneously move a locking cam into a position to engage the support member to secure the support member in the closed position. In particular, the latching member includes an overcenter or toggle type connection between the latch member and a member connected to or supporting the hatch cover and wherein, in the closed position, stable locking engagement is provided between the latch member and the hatch cover. The latch member is pivotally connected to an adjustable link member which is also pivotally secured to the hopper or tank roof and is adjustable so that the locking force exerted on the hatch cover may be adjusted to vary the locking force and the locking effort. A particularly unique T-shaped link member serves as a locking cam and as a pivot member for supporting the latch member.

In accordance with yet a further aspect of the present invention, there is provided a hatch cover and latch member for a railcar hopper wherein, in the open position of the cover and the latching mechanism, the structure provides a relatively low profile, and is provided with means to prevent damage to the car exterior finish and/or internal hopper linings and the like. Those skilled in the art will recognize other advantages and superior features of the present invention upon reading the detailed description which follows in conjunction with the drawing.

DESCRIPTION OF THE PREFERRED EMBODIMENT

Figure 1:
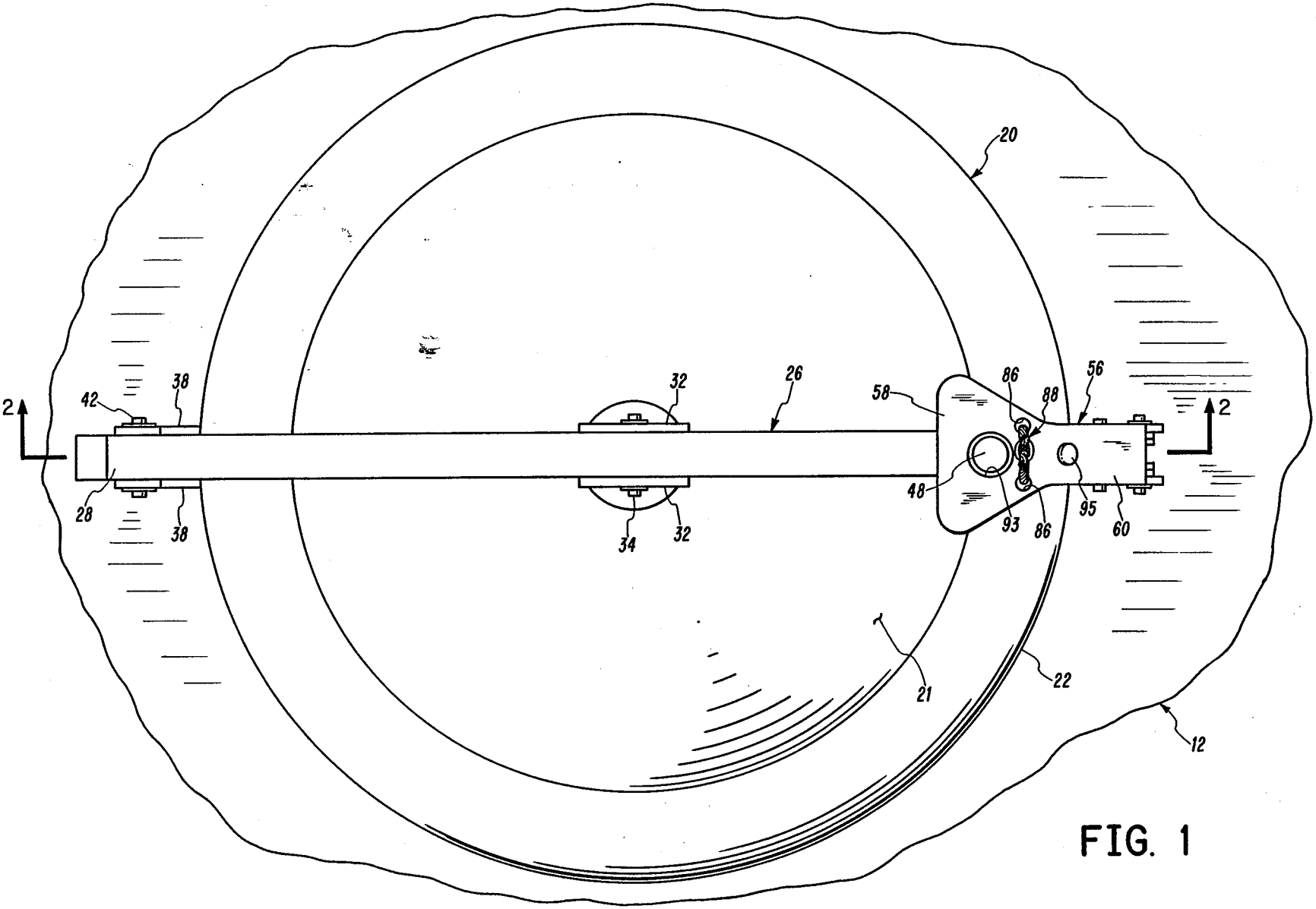
FIG. 1 is a plan view of a portion of a railcar hopper and including the hatch cover and latch mechanism of the present invention.
Figure 2:
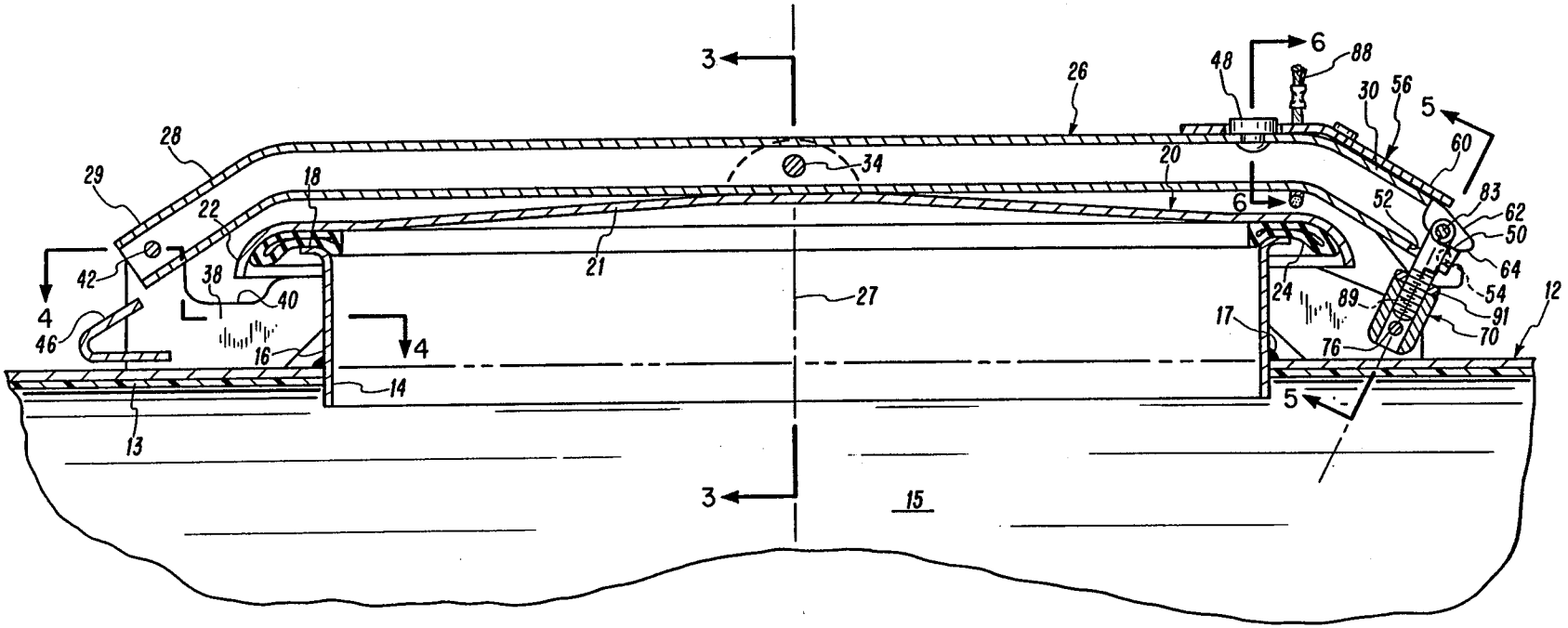
FIG. 2 is a section view taken generally along the line 2—2 of FIG. 1.

In the description which follows like parts are marked throughout the specification and drawing with the same reference numerals, respectively. The drawing figures are not necessarily to scale and certain features of the invention may be shown exaggerated in scale in the interest of clarity. Referring to FIGS. 1 and 2, there is illustrated a roof portion 12 of a railcar hopper or the like, which hopper is adapted to form a substantially closed container for carrying various types of bulk commodities including, for example, pelletized plastic materials. As shown in FIG. 2, the hopper roof 12 includes a hatch opening 14 defined by a generally cylindrical hatch member 16 which is suitably fixed to the hopper roof 12 by a peripheral weld bead 17 or the like.

The hatch 16 is preferably provided with a radially outwardly extending upper flange or coaming 18 forming a seal surface for engagement with and in support of a generally cylindrical hatch cover 20. The hatch cover 20 comprises a generally circular plate member having a slightly raised frusto-conical center portion 21 and a downturned peripheral flange 22 dimensioned to overlie the coaming 18 in the closed position. A relatively thick resilient annular gasket or seal member 24 is suitably secured on the underside of the hatch cover 20 adjacent the flange 22, is engageable with the coaming 18 and is adapted to be distended or compressed to form a substantially fluid tight seal at the hatch opening 14.

Figure 3:
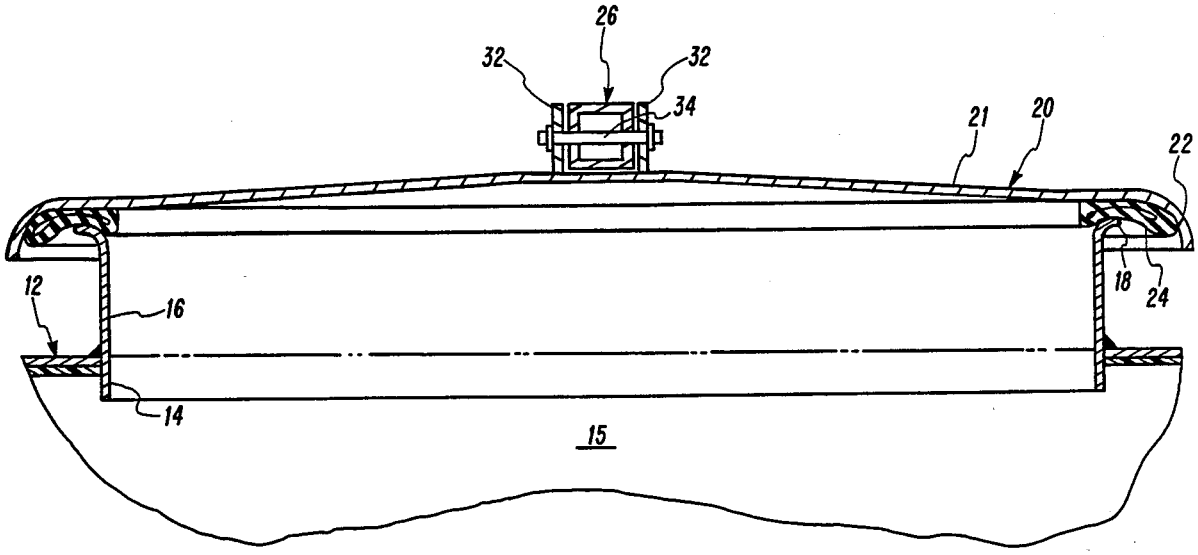
FIG. 3 is a section view taken along the line 3—3 of FIG. 2.

Referring also to FIG. 3, the hatch cover 20 is connected to an elongated support and holddown bar 26 which extends diametrically across the hatch cover 20 and includes opposed end portions 28 and 30 which are downturned in the closed position of the hatch cover illustrated in FIG. 2. The hatch cover 20 includes a pair of spaced apart bracket parts 32 centrally located on the apex of the frusto-conical portion 21 and at a central axis 27, FIG. 2, for receiving the support bar 26 therebetween. A connecting pin 34 is journalled by the brackets 32 and extends through the support bar to form a loose pivotal connection between the hatch cover and the support bar whereby an equalized closing force may be exerted on the hatch cover in the closed position to aid in forming a fluid tight seal by the gasket member 24. As shown in FIGS. 2 and 3, the support part 26 is preferably formed of relatively stiff rectangular cross section metal tubing although the bar may be formed of a high strength nonmetal composite material such as glass or metal fiber reinforced plastic.

Figure 4:
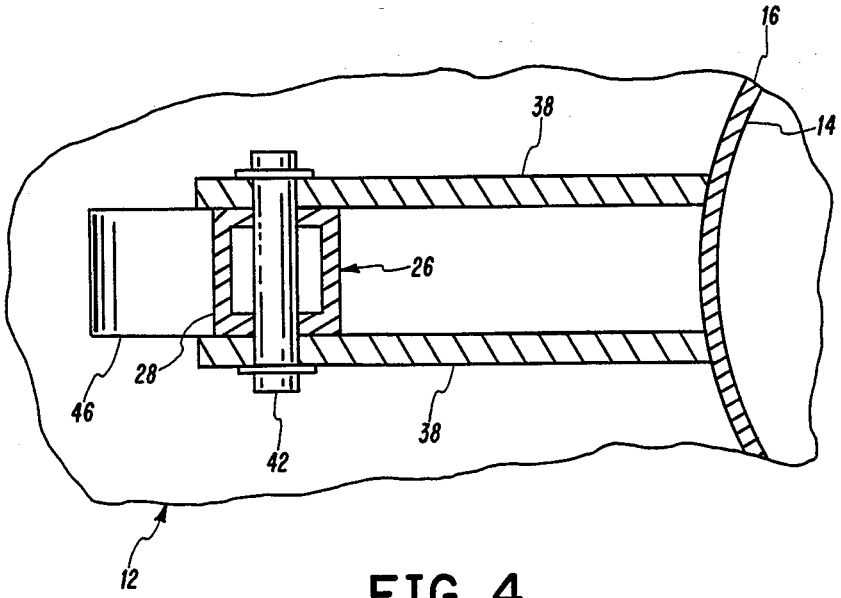
FIG. 4 is a section view taken along the line 4—4 of FIG. 2.
Figure 9:
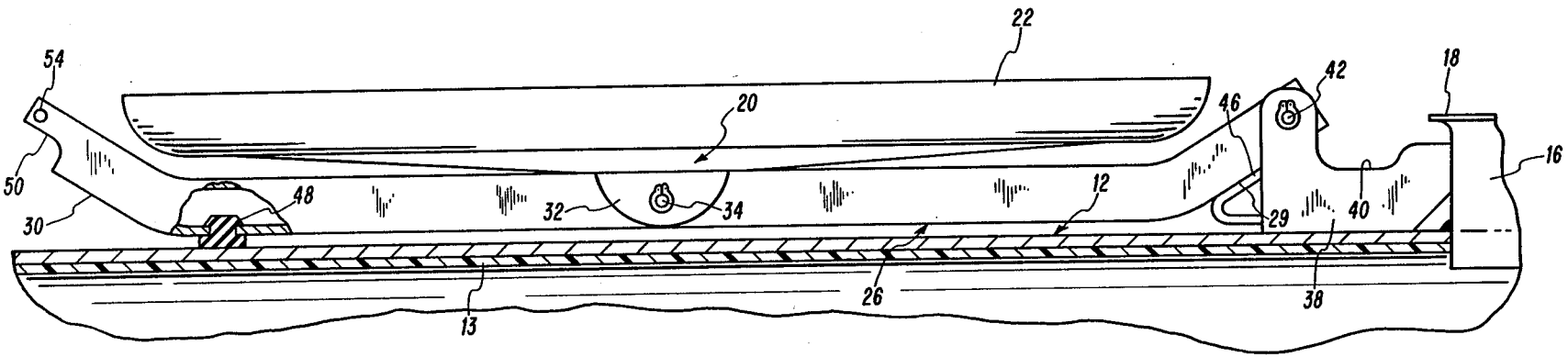
FIG. 9 is a side elevation of the hatch cover in the full open position.

Referring to FIGS. 2 and 4, the hatch cover 20 is provided with hinge means comprising a pair of spaced apart low profile hinge brackets 38 which are suitably secured to the hopper roof 12 and to the hatch 16 such as by welding. A somewhat U-shaped recess 40 is formed in the brackets 38 to provide clearance for the peripheral flange 22 of the hatch cover 20 in its closed position. A hinge connection is formed between the end portion 28 of the support bar 26 and the hinge brackets 38 by an elongated pivot pin 42 journalled by the brackets 38 and extending through the support bar 26. A stop member 46 is disposed between and secured to the brackets 38 and is engageable with the surface 29, FIG. 2, of the support bar end part 28, see FIG. 9 also, to support the hatch cover 20 and the support bar 26 in the full open position of the hatch. An elastomeric bumper 48 is suitably secured to the support bar 26 and is engageable with the hooper roof 12 when the hatch cover is opened to prevent violent impacting of the support bar with the hopper roof. The provision of the bumper 48 also prevents marring and chipping any exterior finish on the roof 12 and prevents damage to any fragile interior coatings or linings 13, as shown in FIG. 9. The stop member 46 is positioned such that the support bar 26 and the hatch cover 20 extend generally horizontally and parallel to the exterior surface 15 of the hopper roof 12 and the bumper 48 cushions any deflection of the support bar 26 in the event the hatch cover 20 is flung open in a careless manner.

Figure 5:
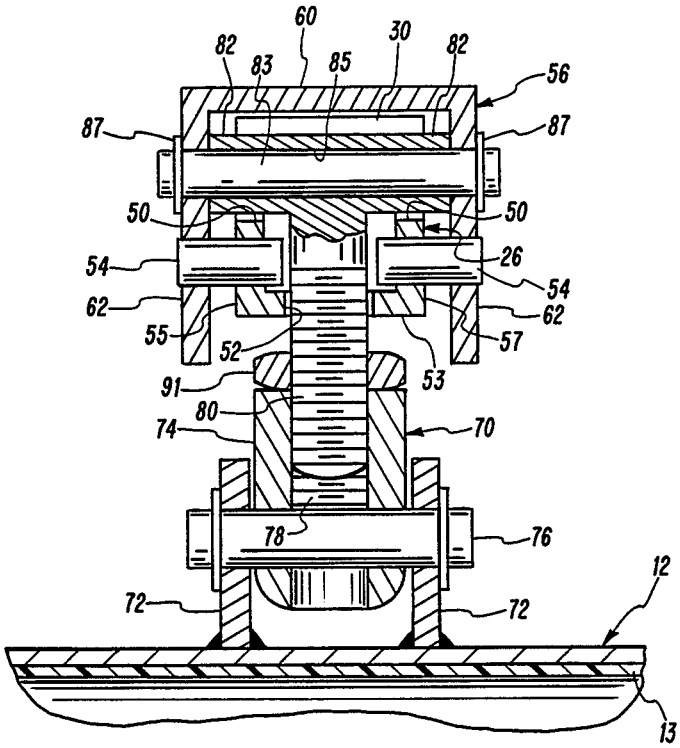
FIG. 5 is a section view taken along the line 5—5 of FIG. 2.

Referring now to FIGS. 2 and 5, the hatch cover 20 is cooperable with a unique latch mechanism for securely locking the cover in the closed position illustrated in FIG. 2 and for minimizing the chance of unwanted release of the hatch cover 20 in such a manner that fluid pressure within the hopper interior 15 might throw the hatch cover open in a violent manner. As shown in FIG. 2, and also somewhat more clearly in FIG. 7, the end portion 30 of the support bar 26 is recessed to form cam surfaces 50 and a longitudinal notch 52 centrally disposed in the bottom sidewall 53 of the support bar and opening to the distal end of the end portion 30. The support bar 26 is also provided with opposed laterally projecting retaining and locking pins 54 which project from opposite side surfaces 55 and 57, FIG. 5, of the support bar 26 generally directly below the cam surfaces 50 when the support bar is oriented in the position illustrated in FIGS. 2, 5 and 7.

The latch mechanism includes a latch member 56 preferably formed from a piece of stamped metal plate or the like having a somewhat enlarged planar handle portion 58 and a channel shaped section formed by a web portion 60 integral with the handle portion 58 and opposed parallel flanges 62, FIG. 5, which extend down over opposite sides of the support bar end part 30 in the closed and locked position of the hatch cover illustrated in FIG. 2 whereby the support bar tends to be nested in the channel shaped portion of the latch member 56. Each of the flanges 62 include open ended slots 64, FIGS. 2, 7 and 8, which are adapted to receive the retaining pins 54. A transverse edge 66 of the web portion 60 delimits the end of the web portion opposite the handle portion 58.

The latch member 56 is pivotally connected to a link or pivot member, generally designated by the numeral 70, which is secured at one end between spaced apart support brackets 72, FIGS. 2 and 5, which are suitably fixed to the hopper roof 12 and/or the hatch member 16. The pivot member 70 includes a socket portion 74 which is disposed between the brackets 72 and pivotally secured thereto by a pivot pin member 76 extending between the brackets 72 and suitably journalled thereby. The socket member 74 is provided with internal threads 78, FIG. 5, for threaded engagement with a shank part 80 of the pivot member 70. The shank 80 is formed integral with opposed cam or trunnion parts 82 to form a somewhat T-shaped member. A pivot pin 83 extends through a bore 85 formed in the head of the shank 80 and coaxial with the trunnions or cams 82. The pin 83 extends through and is journalled at opposite ends by the opposed flanges 62 of the latch member 56. The pin 83 is retained in assembly as shown in FIG. 5 by suitable retaining rings 87.

The trunnions 82 are adapted to be forcibly engaged with the cam surfaces 50 to lock the hatch cover 20 in the closed position illustrated in FIG. 2 and to pivotally support the latch member 56. The arrangement of the pivot member 70 and the latch member 56 in cooperation with the retaining pins 54 on the support bar form an overcenter type locking mechanism operable to retain the hatch cover 20 in securely locked position. For example, as the latch member 56 is rotated in a counterclockwise direction, viewing FIGS. 7 and 8, with the retaining pins 54 nested in the slots 64 the support bar 26 is moved about the hinge axis formed by the hinge pin 42 to forcibly engage the gasket 24 with the coaming 18 and draw the cover 20 down tightly over the hatch opening 14. As this closing movement occurs the shank 80 moves into the slot 52 and the trunnions 82 move into a position to forcibly engage the cam surfaces 50.

Figure 7:
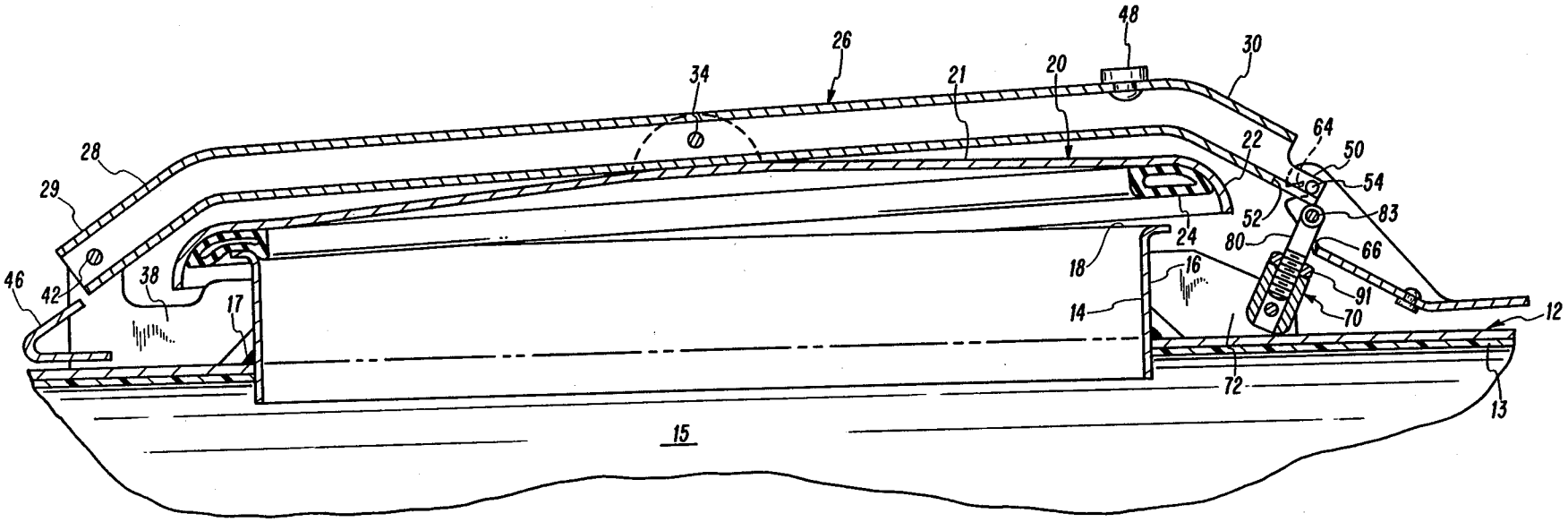
FIG. 7 is a section view similar to FIG. 2 and showing the hatch cover partially opened and engaged by the latching mechanism.
Figure 8:
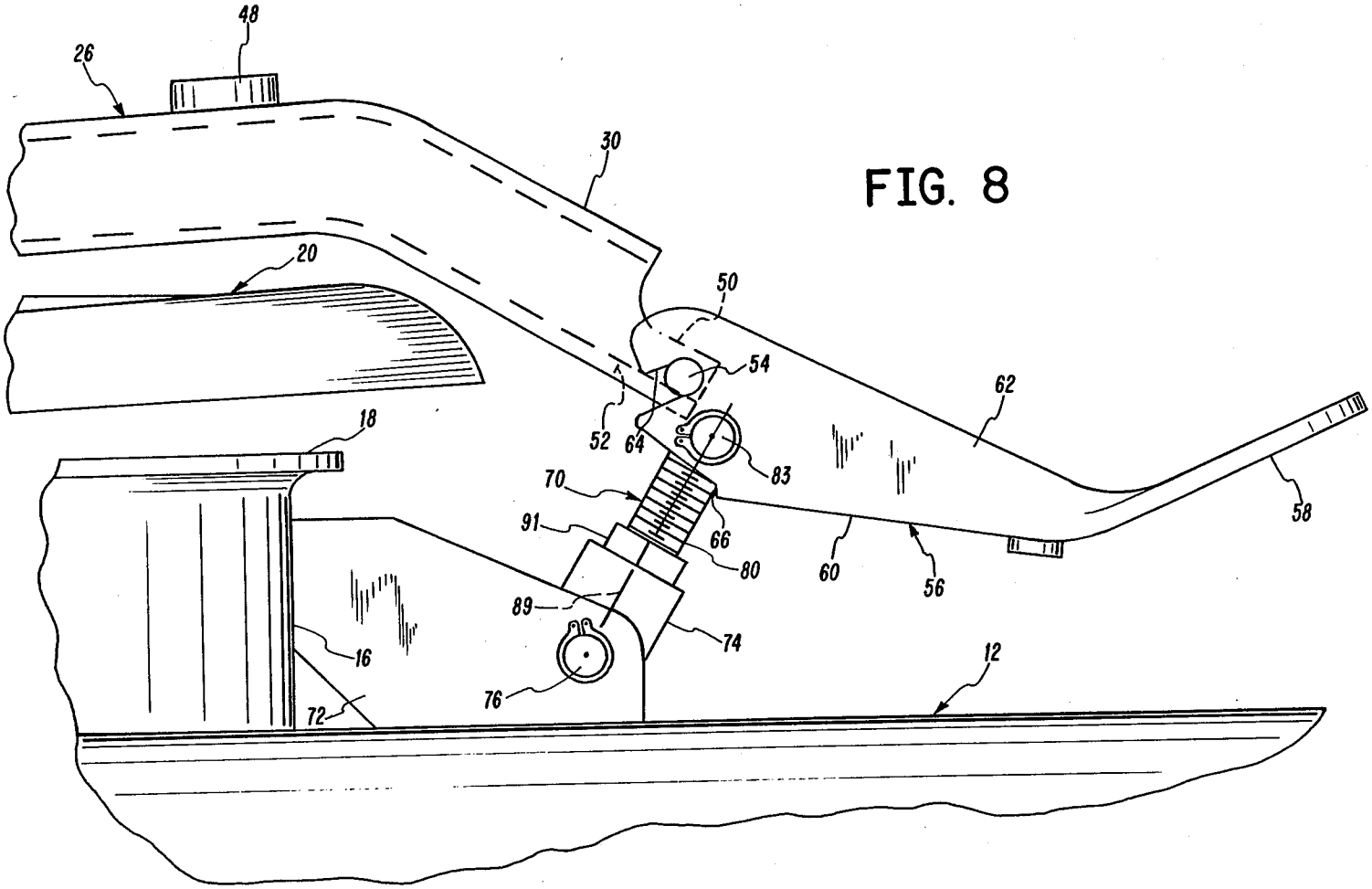
FIG. 8 is a partial side elevation showing the position of the latch mechanism in the partially opened and restrained position of the cover.

As the latch member 56 moves to the position illustrated in FIG. 2, the pivotal movement of the latch member about the pin 83 results in movement of the retaining pins 54 relative to the pin 83 and the pivot pin 76 through an overcenter position by moving from one side of a centerline 89, FIG. 8, extending between the pivot pins to the other side illustrated in FIG. 2 to accomplish an overcenter or toggle type locking function wherein the forces tending to open the hatch cover 20 such as due to fluid pressure within the opening 14 or the elastic memory of the gasket 24 tend to bias the trunnions 82 into tighter engagement with the cam surfaces 50 and to bias the pivot member 70 to pivot in a counterclockwise direction about the axis of pin 76 viewing FIGS. 2, 7 and 8. The threaded engagement between the parts comprising the socket 74 and the shank 80 of the pivot member 70 are adjustable relative to each other to adjust the distance between the pin 76 and the trunnions 82, and the relative position of the pivot points formed by the pins 76 and 83 may be secured by a lock nut 91 engageable with the socket 74.

Figure 6:
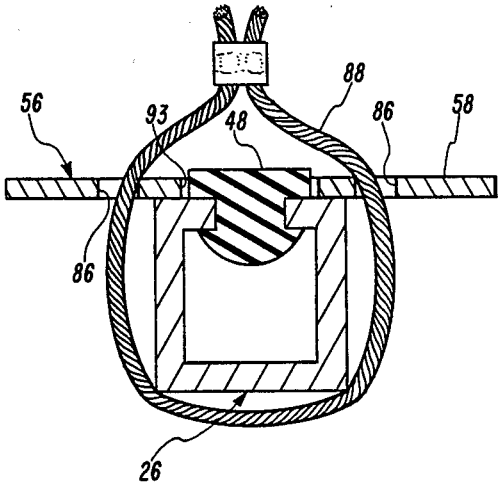
FIG. 6 is a section view taken along the line 6—6 of FIG. 2.
Figure 10:
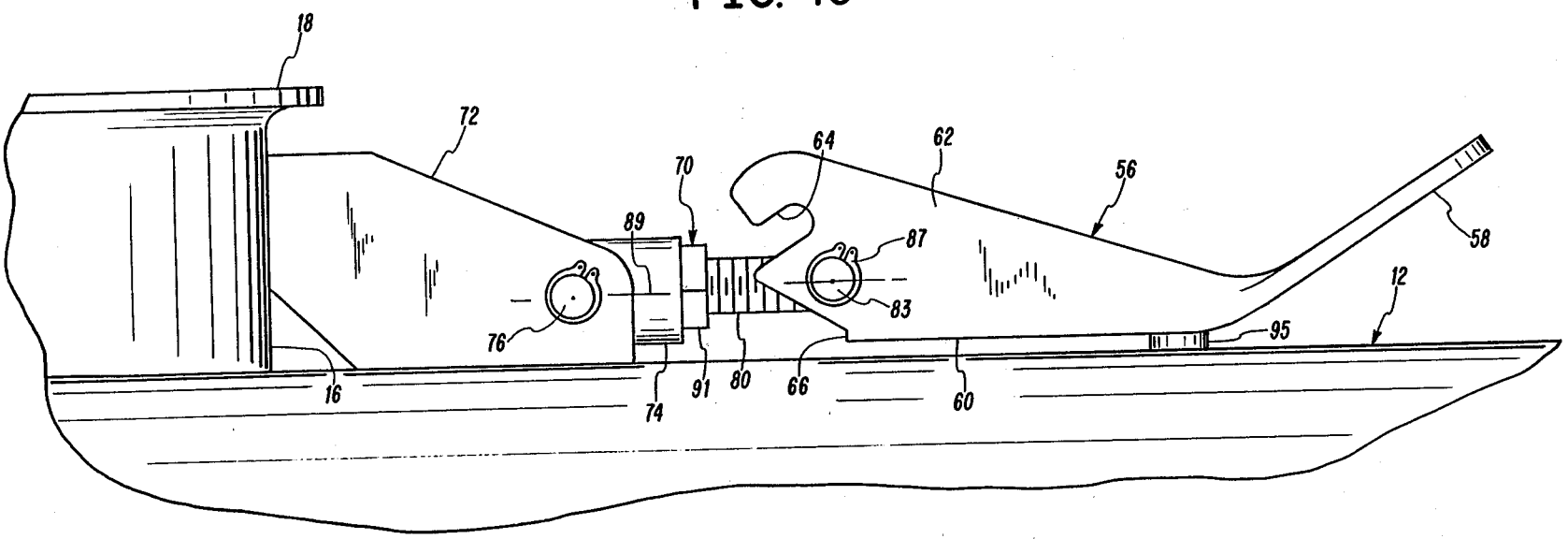
FIG. 10 is a detail side elevation of the latch member in the released or disengaged positioned.

In the closed position of the latch member 56 the handle part 58 overlies the support bar 20 and is contiguous therewith. A suitable opening 93, FIG. 1, is provided in the handle part to provide clearance for the bumper 48. The handle part 58 also conveniently includes spaced apart holes 86, FIGS. 1 and 6, whereby a security seal strap 88 may be threaded through the holes and adapted to secure the latch member 56 in its hatch closed position to the support bar 26. The latch member 56 also includes a resilient bumber 95 suitably secured to the web 60 to cushion the impact of the latch member 56 with the hopper roof 12 when the latch member is thrown to the open position illustrated in FIG. 10. Thanks to the configuration of the channel shaped latch member 56 and the generally planar plate-like handle portion 58 which overlies the support bar 26 in the closed position of the hatch cover the overall height of the hatch cover is reduced and it does not present a substantial obstruction to personnel walking along the hopper roof.

The latch mechanism including the latch member 56 and the pivot member 70 also provides for minimizing the chance of unwanted violent opening of the hatch cover 20 upon release of the latch member from its closed and locked position illustrated in FIG. 2. For example, when the latch member 56 is moved from the FIG. 2 position to the FIGS. 7 and 8 position, if fluid pressure within the hatch opening 14 is sufficient to force the hatch cover 20 towards the full open position, the retaining pins 54 will remain engaged in the slots 64 since pivotal movement of the latch member 56 about the axis of the pin 83 will be limited by engagement of the edge 66 with the shank portion 80 in the position shown in FIGS. 7 and 8. In this position the slots 64 are directed at a downward angle and the retaining pins 54 tend to remain nested in the slots to prevent the hatch cover 20 from swinging to the full open position. However, upon relief of pressure in the hatch opening 14 the hatch cover 20 will tend to move back toward a closed position under the force of gravity acting thereon, which movement will tend to pivot the pivot member 70 in a clockwise direction, viewing FIG. 7, about the axis of pivot pin 76 and the force of gravity acting on the latch member 56 in the FIG. 7 position will result in the movement of the latch member to the position shown in FIG. 10 to disengage from the retaining pins whereby the hatch cover 20 may then be manually moved to the full open position illustrated in FIG. 9. Accordingly, the combination of the latch member 56 and the pivot member 70 provides for retaining the hatch cover 20 in only a slightly open position when the hatch cover is unlocked to permit relief of any fluid pressure buildup within the railcar hopper and, upon bleedoff of the fluid pressure sufficiently to allow the hatch cover to close under its own weight, the latching mechanism automatically releases from engagement with the support bar without further effort by operating personnel.

When it is desired to close the hatch cover 20 and securely lock it with the latching mechanism described herein the cover may be swung about its hinge axis formed by the pin 42 from the open position shown in FIG. 9 to the position shown in FIG. 7 whereupon the weight of the cover will begin compressing the gasket 24 so that the cover will move slightly further toward the FIG. 2 position. The latch member 56 may then be swung into a position wherein the retaining pins 54 are disposed in the slots 64 and, upon forcible pivotal movement of the latch member 56 about the pivot axis formed by the pin 83 the cover 20 will be forced down so that the gasket 24 is in tight uniformly squeezed engagement with the coaming 18 and then the cover is securely locked as the latch member is moved to the FIG. 2 position.

It will be appreciated from the foregoing description that the latching mechanism comprising the latch member 56, the pivot member 70 and the cooperating portions of the support bar 26 provide a convenient and secure means for locking a hatch cover in a closed position and, in particular, for a hatch cover which is hinged for movement about a hinge axis spaced from and generally parallel to the pivot axis of the latch member 56. It will also be appreciated that a unique latch retaining feature is provided for allowing the hatch cover 20 to open sufficiently to relieve any pressure differential within the hopper or tank and followed by automatic disengagement of the latching mechanism. The latching mechanism provides a low profile structure which does not obstruct movement by personnel along the hopper roof 12 when the hatch cover 20 is in the closed or open position. The latching mechanism is easily adjusted to compensate for gaskets of different resiliency as well as for manufacturing tolerances in the positional relationships of all of the cooperating parts. The hatch cover 20, the support bar 26 and the latching mechanism including the latch member 56 and the pivot member 70 may be manufactured of conventional engineering materials including aluminum and steel alloys, and the hatch cover and the support bar, in particular, may be fabricated of fiber reinforced plastics or other non-metallic material.

Although a preferred embodiment of the invention has been described herein in detail, those skilled in the art will appreciate that various substitutions and modifications may be made to the specific embodiment disclosed without departing from the scope and spirit of the invention as recited in the appended claims.

What I claim is:

1. A cover for closure over a hatch opening in a railway car hopper means or the like, comprising;

a cover member adapted to be closed over means forming a hatch opening in said hopper means;

hinge means connected to said cover member for moving said cover member between an open position and a closed position in sealed engagement with said means forming said hatch opening;

closure latch means for locking said cover member in said closed position and including a latch member operable to be moved in stages from a cover locking position to a first position permitting only partial opening movement of said cover and from said first position to a second position releasing said cover member for movement to a full open position;

link means operable when said latch member is in said first position and fluid pressure is being exerted against the inside of said cover member to provide an interlock preventing movement of said latch member to said second position until after the fluid pressure has been relieved;

said latch member is pivotally connected to said link means and said link means includes a first pivot member connected to means fixed to said hopper means, and said latch member includes means cooperable with means connected to said cover member for limiting the movement of said cover member to said first position and for moving said cover to said closed position;

said latch member and said means connected to said cover member include cooperating slot means and pin means formed on said latch member and said means connected to said cover member for moving said cover member to a closed and latched position and for retaining said cover member engaged with said latch member in said first position partially opened to relieve said fluid pressure; and said latch member includes a surface engageable with said link means to limit pivotal movement of said latch member so as to maintain said pin means in said slot means until said cover member moves from said partially open first position toward said closed position in response to relief of fluid pressure in said hopper means.

2. A cover for closure over a hatch opening in a railway car hopper means or the like, comprising;

a cover member adapted to be closed over means forming a hatch opening in said hopper means;

hinge means connected to said cover member for moving said cover member between an open position and a closed position in sealed engagement with said means forming said hatch opening;

closure latch means for locking said cover member in said closed position and including a latch member operable to be moved in stages from a cover locking position to a first position permitting only partial opening movement of said cover and from said first position to a second position releasing said cover member for movement to a full open position;

link means operable when said latch member is in said first position and fluid pressure is being exerted against the inside of said cover member to provide an interlock preventing movement of said latch member to said second position until after the fluid pressure has been relieved;

said latch member is pivotally connected to said link means and said link means includes a first pivot member connected to means fixed to said hopper means, and said latch member includes means cooperable with means connected to said cover member for limiting the movement of said cover member to said first position and for moving said cover to said closed position;

said latch member and said means connected to said cover member include cooperating slot means and pin means formed on said latch member and said means connected to said cover member for moving said cover member to a closed and latched position and for retaining said cover member engaged with said latch member in said first position partially opened to relieve said fluid pressure;

said latch member includes a handle portion and a channel shaped portion having opposed flanges and a connecting web, said flanges including respective slots comprising said slot means, and said pin means comprise opposed pin parts on said means connected to said cover member; and said latch member includes a surface engageable with said link means to limit pivotal movement of said latch member so as to maintain said pin means in said slot means until said cover member moves from said partially open first position toward said closed position in response to relief of fluid pressure in said hopper means.

3. A cover for closure over a hatch opening in a railway car hopper means or the like, comprising;

a cover member adapted to be closed over means forming a hatch opening in said hopper means;

hinge means connected to said cover member for moving said cover member between an open position and a closed position in sealed engagement with said means forming said hatch opening;

closure latch means for locking said cover member in said closed position and including a latch member operable to be moved in stages from a cover locking position to a first position permitting only partial opening movement of said cover and from said first position to a second position releasing said cover member for movement to a full open position;

link means operable when said latch member is in said first position and fluid pressure is being exerted against the inside of said cover member to provide an interlock preventing movement of said latch member to said second position until after the fluid pressure has been relieved;

said latch member is pivotally connected to said link means and said link means includes a first pivot member connected to means fixed to said hopper means, and said latch member includes means cooperable with means connected to said cover member for limiting the movement of said cover member to said first position and for moving said cover to said closed position; and said latch member and said means connected to said cover member include cooperating slot means and pin means formed on said latch member and said means connected to said cover member for moving said cover member to a closed and latched position and for retaining said cover member engaged with said latch member in said first position partially opened to relieve said fluid pressure;

said latch member includes a handle portion and a channel shaped portion having opposed flanges and a connecting web, said flanges including respective slots comprising said slot means, and said pin means comprise opposed pin parts on said means connected to said cover member;

said latch member includes a surface engageable with said link means to limit pivotal movement of said latch member so as to maintain said pin means in said slot means until said cover member moves from said partially open first position toward said closed position in response to relief of fluid pressure in said hopper means; and said means connected to said cover member is nested between said flanges and beneath said handle part of said latch member in the closed and locked position of said latch member, and said latch member includes means cooperable with a seal strap to retain said latch member and said support bar in nested relationship and said hatch cover locked.

4. A hatch cover for closing a hatch opening in a railway car hopper roof or the like, said hopper roof including an upstanding peripheral wall defining said hatch opening and having a perimeter seal edge formed thereon, said hatch cover including:

a cover member including means engageable with said seal edge to close said hatch opening;

an elongated support bar connected to said cover member by pivot connection means disposed substantially at the center of said cover member, said support bar being connected at one end to hinge means for moving said cover member between open and closed positions;

a latch member including means cooperable with an end of said support bar opposite said one end for locking said cover member including a generally planar handle part and a channel shaped portion extending from said handle part including opposed flanges and a connecting web, said handle part overlying and being substantially contiguous with said support bar in the closed position of said cover and with said support bar nested between said flanges, said latch member being operable to be moved in stages from a cover locking position to a first position permitting only partial opening movement of said cover and from said first position to a second position releasing said cover member for movement to a full open position;

said latch member and said support bar include cooperating pin and slot means providing for engagement of said latch member with said support bar to move said support bar to a cover closed and locked position and to retain said support bar engaged with said latch member in a said first position of said cover member;

a pivot member pivotally connected at one end to said latch member and pivotally connected at its opposite end to means secured to said roof, said pivot member including means operable when said latch member is in said first position and fluid pressure is being exerted against the inside of said cover member to provide an interlock against movement of said latch member to said second position until after the fluid pressure has been relieved;

said pivot member includes a shank portion and opposed trunnion portions extending from said shank portion and pivotally ssecured to respective ones of said flanges, said trunnion portions being engageable with cooperating surface means on said support bar for locking said cover member in a closed position; and said latch member includes a portion engageable with said pivot member to limit the pivotal movement of said latch member so as to maintain said pin means and slot means engaged in said first position and to permit said latch member moving from said partially open position toward said closed position.

5. A hatch cover for closing a hatch opening in a railway car hopper or the like, said hopper including a peripheral wall defining said hatch opening, said hatch cover including:

a cover member including means engageable with said wall to close said hatch opening:

hinge means for moving said cover member between open and closed positions;

a latch member;

a pivot member pivotally connected at one end to said latch member and pivotally connected at its opposite end to means secured to said hopper;

said pivot member including a shank portion and opposed trunnion portions engageable with cooperable cam surface means secured to said cover member for locking said cover member in a closed position;

cooperating pin and slot means formed on said latch member and on means secured to said cover member and operable to move said cover member to a closed and locked position and while fluid pressure is being exerted against the inside of said cover member to prevent said cover member from being disconnected from said latch member in a partially open position of said cover member until after the fluid pressure against said cover member has been relieved; and said latch member includes a portion engageable with said pivot member to limit the pivotal movement of said latch member so as to maintain said pin means and slot means engaged in said partially open position.

6. A cover for closure over a hatch opening in a railway car hopper means or the like, comprising;

a cover member adapted to be closed over means forming a hatch opening in said hopper means;

hinge means connected to said cover member for moving said cover member between an open position and a closed position in sealed engagement with said means forming said hatch opening;

closure latch means for locking said cover member in said closed position and including a latch member operable to be moved in stages from a cover locking position to a first position permitting only partial opening movement of said cover and from said first position to a second position releasing said cover member for movement to a full open position;

link means operable when said latch member is in said first position and fluid pressure is being exerted against the inside of said cover member to provide an interlock preventing movement of said latch member to said second position until after the fluid pressure has been relieved;

said latch member is pivotally connected to said link means and said link means includes a first pivot member connected to means fixed to said hopper means, and said latch member includes means cooperable with means connected to said cover member for limiting the movement of said cover member to said first position and for moving said cover to said closed position;

said link means includes a second pivot member for moving said latch member to a position to release said cover member to be moved to a full open position;

a common center line is defined extending between said pivotal connections and the cooperable elements of said latch member and said cover member are concomitantly displaced when said cover member is moved between said first position and said closed position in an over-center relation from one side of said center line to the other side of said center line; and the cooperable elements of said latch member and said cover member are displaced arcuately about the pivot axis of said latch member when said cover member is moved between said first position and said closed position.

7. A cover for closure over a hatch opening in a railway car hopper means or the like, comprising;

a cover member adapted to be closed over means forming a hatch opening in said hopper means;

hinge means connected to said cover member for moving said cover member between an open position and a closed position in sealed engagement with said means forming said hatch opening;

closure latch means for locking said cover member in said closed position and including a latch member operable to be moved in stages from a cover locking position to a first position permitting only partial opening movement of said cover and from said first position to a second position releasing said cover member for movement to a full open position;

link means operable when said latch member is in said first position and fluid pressure is being exerted against the inside of said cover member to provide an interlock preventing movement of said latch member to said second position until after the fluid pressure has been relieved;

said latch member is pivotally connected to said link means and said link means includes a first pivot member connected to means fixed to said hopper means, and said latch member includes means cooperable with means connected to said cover member for limiting the movement of said cover member to said first position and for moving said cover to said closed position;

said link means includes a second pivot member for moving said latch member to a position to release said cover member to be moved to a full open position;

said first and second pivot members are connected by means operable to adjust the position of first and second pivot axis of said first and second pivot members, respectively, to adjust the latching force of said latch member on said cover;

a common center line is defined extending between said pivotal connections and the cooperable elements of said latch member and said cover member are concomitantly displaced when said cover member is moved between said first position and said closed position in an over-center relation from one side of said center line to the other side of said center line; and the cooperable elements of said latch member and said cover member are displaced arcuately about the pivot axis of said latch member when said cover member is moved between said first position and said closed position.

8. A hatch cover for closing a hatch opening in a railway car hopper roof or the like, said hopper roof including an upstanding peripheral wall defining said hatch opening and having a perimeter seal edge formed thereon, said hatch cover including:

a cover member including means engageable with said seal edge to close said hatch opening;

an elongated support bar connected to said cover member by pivot connection means disposed substantially at the center of said cover member, said support bar being connected at one end to hinge means for moving said cover member between open and closed positions;

a latch member including means cooperable with an end of said support bar opposite said one end for locking said cover member including a generally planar handle part and a channel shaped portion extending from said handle part including opposed flanges and a connecting web, said handle part overlying and being substantially contiguous with said support bar in the closed position of said cover and with said support bar nested between said flanges, said latch member being operable to be moved in stages from a cover locking position to a first position permitting only partial opening movement of said cover and from said first position to a second position releasing said cover member for movement to a full open position;

a pivot member pivotally connected at one end to said latch member and pivotally connected at its opposite end to means secured to said roof, said pivot member including means operable when said latch member is in said first position and fluid pressure is being exerted against the inside of said cover member to provide an interlock against movement of said latch member to said second position until after the fluid pressure has been relieved;

a common center line is defined extending between said pivotal connections and the cooperable elements of said latch member and said cover member are concomitantly displaced when said cover member is moved between said first position and said closed position in an over-center relation from one side of said center line to the other side of said center line; and the cooperable elements of said latch member and said cover member are displaced arcuately about the pivot axis of said latch member when said cover member is moved between said first position and said closed position.

9. A hatch cover for closing a hatch opening in a railway car hopper or the like, said hopper including a peripheral wall defining said hatch opening, said hatch cover including:

a cover member including means engageable with said wall to close said hatch opening:

hinge means for moving said cover member between open and closed positions;

a latch member;

a pivot member pivotally connected at one end to said latch member and pivotally connected at its opposite end to means secured to said hopper;

said pivot member including a shank portion and opposed trunnion portions engageable with cooperable cam surface means secured to said cover member for locking said cover member in a closed position;

cooperating pin and slot means formed on said latch member and on means secured to said cover member and operable to move said cover member to a closed and locked position and while fluid pressure is being exerted against the inside of said cover member to prevent said cover member from being disconnected from said latch member in a partially open position of said cover member until after the fluid pressure against said cover member has been relieved;

a common center line is defined extending between said pivotal connections and the cooperable elements of said latch member and said cover member are concomitantly displaced when said cover member is moved between said first position and said closed position in an over-center relation from one side of said center line to the other side of said center line; and the cooperable elements of said latch member and said cover member are displaced arcuately about the pivot axis of said latch member when said cover member is moved between said first position and said closed position.

10. A cover for closure over a hatch opening in a railway car hopper means or the like, comprising;

a cover member adapted to be closed over means forming a hatch opening in said hopper means;

hinge means connected to said cover member for moving said cover member between an open position and a closed position in sealed engagement with said means forming said hatch opening;

closure latch means for locking said cover member in said closed position and including a latch member operable to be moved in stages from a cover locking position to a first position permitting only partial opening movement of said cover and from said first position to a second position releasing said cover member for movement to a full open position after the fluid pressure in said hopper means has been relieved, said latch member being pivotally connected to link means including a first pivot member connected to means fixed to said hopper means, said latch member including means cooperable with means connected to said cover member for limiting the movement of said cover member to said partially open first position and for moving said cover member to said closed position;

said link means being operable when said latch member is in said first position and fluid pressure is being exerted against the inside of said hopper to provide an interlock preventing movement of said latch member to said second position until after the fluid pressure has been relieved and including a second pivot member operable to provide for movement of said latch member to said second position to release said cover member to be moved to a full open position;

a common center line is defined extending between said pivotal connections and the cooperable elements of said latch member and said cover member are concomitantly displaced when said cover member is moved between said first position and said closed position in an over-center relation from one side of said center line to the other side of said center line; and the cooperable elements of said latch member and said cover member are displaced arcuately about the pivot axis of said latch member when said cover member is moved between said first position and said closed position.

* * * * *